US010556363B2

(12) United States Patent
Duan et al.

(10) Patent No.: US 10,556,363 B2
(45) Date of Patent: Feb. 11, 2020

(54) ELECTRIC STAPLER

(71) Applicant: NINGBO WEISHU STATIONERY CO., LTD, Ningbo, Zhejiang (CN)

(72) Inventors: Zhongmin Duan, Zhejiang (CN); Changhai Dai, Zhejiang (CN)

(73) Assignee: NINGBO WEISHU STATIONERY CO., LTD, Ningbo, Zhejian (CN)

( * ) Notice: Subject to any disclaimer, the term of this patent is extended or adjusted under 35 U.S.C. 154(b) by 262 days.

(21) Appl. No.: 15/676,184

(22) Filed: Aug. 14, 2017

(65) Prior Publication Data

US 2018/0319036 A1 Nov. 8, 2018

(30) Foreign Application Priority Data

May 5, 2017 (CN) ..... 2017 1 0311859

(51) Int. Cl.

| | |
|---|---|
| ***B27F 7/36*** | (2006.01) |
| ***B25C 5/02*** | (2006.01) |
| ***B25C 5/15*** | (2006.01) |
| ***B25C 1/06*** | (2006.01) |
| ***B25C 5/16*** | (2006.01) |

(52) U.S. Cl.

CPC ..... *B27F 7/36* (2013.01); *B25C 1/06* (2013.01); *B25C 5/0228* (2013.01); *B25C 5/15* (2013.01); *B25C 5/16* (2013.01)

(58) Field of Classification Search

CPC . B27F 7/36; B25C 1/06; B25C 5/0228; B25C 5/15; B25C 5/16

USPC ..... 227/2, 5, 6, 7, 82, 85, 127, 131, 132, 227/133, 147, 155, 156

See application file for complete search history.

(56) References Cited

U.S. PATENT DOCUMENTS 5,222,645 A * 6/1993 Sueda ..... B25C 5/0228 227/131
6,068,173 A * 5/2000 Sueda ..... B25C 5/0228 227/131

(Continued)

FOREIGN PATENT DOCUMENTS

CN 2633573 Y * 8/2004
CN 2633573 Y 8/2004

OTHER PUBLICATIONS

The Chinese 1st Office Action dated Dec. 20, 2018 for Application No. CN201710311859.8.

*Primary Examiner* — Alexander M Valvis
*Assistant Examiner* — David G Shutty
(74) *Attorney, Agent, or Firm* — Yue(Robert) Xu; Apex Attorneys at Law, LLP

(57) ABSTRACT

An electric stapler includes a base and a press portion articulated to the base. The press portion is provided with, from down to up, a staple channel assembly configured to receive a staple, a staple pressing plate assembly configured to press the staple and a drive assembly in sequence. The position of the drive assembly is fixed relative to the press portion. The staple channel assembly and the staple pressing plate assembly are rotatable relative to the press portion. The drive assembly includes a power unit and an execution component connected to the power unit to press or raise the staple pressing plate assembly. The above electric stapler addresses the technical issues that the staple channel cannot reset automatically after the staple is stuck and it is difficult to clear away a failed staple.

8 Claims, 6 Drawing Sheets

(56) References Cited

U.S. PATENT DOCUMENTS

| | | | | |
|---|---|---|---|---|
| 7,389,902 | B1 * | 6/2008 | Co | B25C 5/15 227/120 |
| 2004/0016789 | A1 * | 1/2004 | Takada | B25C 5/0228 227/7 |
| 2005/0067456 | A1 * | 3/2005 | Lammers | B25C 5/0292 227/131 |
| 2018/0319203 | A1 * | 11/2018 | Dai | B43L 23/02 |

* cited by examiner

ELECTRIC STAPLER

CROSS REFERENCE OF RELATED APPLICATION

The present application claims the priority to Chinese Patent Application No. 201710311859.8, titled "ELECTRIC STAPLER", filed on May 5, 2017 with the State Intellectual Property Office of the People's Republic of China, the content of which application is incorporated herein by reference in its entirety.

FIELD

This application relates to the technical field of staplers, and particularly to an electric stapler.

BACKGROUND

Staplers, as a binding tool, widely exist in households and offices.

A stapler in the conventional technology operates based on the following principle. When the hand presses firmly an end cover of the stapler, an ejector, staples and a fixture may be rotated around a connecting pin. With the force being continuously applied by the hand, the ejector may be rotated to get out its natural state, and at this time, the ejector may perform an approximate up and down movement with a range slightly greater than the height of a staple about the connecting pin vertically, an end cover spring is compressed, and an elastic strip is compressed, and accordingly the staple may be driven to move downwards. After moving by a certain distance, the staple may come into contact with an object to be bound and penetrate the object under the action of the manual force. The staple, after penetrating the object, may run into a mold and the tip of the staple may be bent, thus realizing the penetration and binding of the object with the staple.

After the binding is finished, the action of the force applied on the end cover of the stapler is removed manually. At this time, the elastic strip may spring back, and the staple, the fixture, the ejector and the end cover may be raised back under the action of the elastic force. Then the springback of the end cover spring allows the ejector and the end cover to be raised back further and the ejector is disengaged from the fixture. The expansion of a push-travel spring drives the staple to be fed again, and accordingly allows the stapler to return to an initial state to wait for a next binding.

SUMMARY

An object of the present application is to provide an electric stapler which addresses the technical issues of the current conventional stapler that the staple channel cannot reset automatically when staple is stuck and it is difficult to clear away a failed staple.

In order to achieve the above objects, an electric stapler is provided according to the present application, which includes a base and a press portion articulated to the base. The press portion is provided with, from down to up, a staple channel assembly configured to receive a staple, a staple pressing plate assembly configured to press downwards the staple, and a drive assembly in sequence; a position of the drive assembly keeps fixed relative to the press portion, the staple channel assembly and the staple pressing plate assembly are rotatable relative to the press portion; and the drive assembly includes a power unit and an execution component connected to the power unit to press downwards or raise the staple pressing plate assembly.

Compared with the above-mentioned background art, the core of the electric stapler according to the present application lies in that the drive assembly having the power unit and the execution component is additionally provided. Under the action of the power unit, the execution component presses downwards or raises the staple pressing plate assembly, to allow the staple pressing plate assembly to abut against or be separated from the staple channel assembly, and the power unit is generally electrically controlled. When the staple is stuck, the staple pressing plate assembly and the staple channel assembly are locked by the failed staple, resulting in that the staple pressing plate assembly and the staple channel assembly cannot be relatively rotated, and thus cannot achieve a next stapling action. In the present application, the staple pressing plate assembly is raised by using the execution component, to achieve the separation of the staple pressing plate assembly from the staple channel assembly, and the failed staple can be removed from the space between the staple pressing plate assembly and the staple channel assembly. Thus such technical issues can be addressed in time that the staple channel cannot reset automatically due to the staple being stuck and it is difficult to clear away a failed staple.

Preferably, the staple pressing plate assembly includes:

a fixed plate extending axially along the base, a staple pressing plate arranged at a front end of the fixed plate and extending vertically downwards, a return stroke ring having an arched shape and arranged on an upper surface of the fixed plate, and a press plate arranged at the upper surface of the fixed plate and located within an area of the return stroke ring; and the execution component includes:

a drive wheel, and a press wheel arranged at the drive wheel and being capable of abutting against the press plate and the return stroke ring;

when the drive wheel rotates in a first direction, the press wheel presses downwards the press plate and then stops rotating, to drive the staple pressing plate assembly to press downwards the staple channel assembly; and when the press wheel is separated from the press plate and the drive wheel continues to rotate in the first direction, the press wheel abuts against an inner wall of the top of the return stroke ring and drives the staple pressing plate assembly to move in a direction away from the staple channel assembly.

Preferably, the staple channel assembly includes a staple channel sliding groove articulated to the base, the staple channel sliding groove is provided with a slidable staple channel; a torsion spring and a staple channel draw hook are provided at a tail end of the staple channel assembly and abut against the staple channel.

Preferably, a battery configured for the power unit to rotate is arranged inside the base.

Preferably, the electric stapler further includes an MCU, a first switch, a second switch, a first drive circuit and a second drive circuit;

the first switch is arranged at the press portion, the drive wheel is provided with a contact protrusion, when the drive wheel rotates to abut the contact protrusion against a press-button of the first switch, the first switch is turned-on, and when the contact protrusion is separated from the press-button, the first switch is turned-off;

the second switch is arranged below a staple outlet of the staple channel assembly, and when the paper touches the second switch, the second switch is turned-on, and when the paper does not touch the second switch, the second switch is turned-off;

the first switch and the second switch are connected to two input pins of the MCU respectively;

a first end of the first drive circuit and a first end of the second drive circuit are connected to two output pins of the MCU respectively, a second end of the first drive circuit is connected to a first end of the power unit, a second end of the second drive circuit is connected to a second end of the power unit, the second end of the first drive circuit is in communication with the second end of the second drive circuit;

a first ground electrode and a first voltage electrode are connected between the first end of the first drive circuit and the second end of the first drive circuit, a second ground electrode and a second voltage electrode are connected between the first end of the second drive circuit and the second end of the second drive circuit; and when the first switch is turned-on and the second switch is turned-off, the power unit keeps still, and when the first switch is turned-on and the second switch is turned-on, the power unit rotates in a first direction, and when the first switch is turned-off and the second switch is turned-on, the power unit rotates in a second direction.

Preferably, the first drive circuit includes a first NPN-type triode, a first PMOS transistor and a first NMOS transistor;

a base of the first NPN-type triode is connected to the MCU, an emitter of the first NPN-type triode is connected to the first ground electrode, a collector of the first NPN-type triode is connected to the first voltage electrode, a grid electrode of the first PMOS transistor and a grid electrode of the first NMOS transistor are both connected between the collector of the first NPN-type triode and the first voltage electrode;

a source electrode of the first PMOS transistor and a drain electrode of the first NMOS transistor are both connected to the first end of the power unit;

the second drive circuit includes a second NPN-type triode, a second PMOS transistor and a second NMOS transistor;

a base of the second NPN-type triode is connected to the MCU, an emitter of the second NPN-type triode is connected to the second ground electrode, a collector of the second NPN-type triode is connected to the second voltage electrode;

a grid electrode of the second PMOS transistor and a grid electrode of the second NMOS transistor are both connected between the collector of the second NPN-type triode and the second voltage electrode;

a source electrode of the second PMOS transistor and a drain electrode of the second NMOS transistor are both connected to the second end of the power unit; and a source electrode of the first NMOS transistor and a source electrode of the second NMOS transistor are connected and grounded; the source electrode of the first PMOS transistor and the source electrode of the second PMOS transistor are connected, a drain electrode of the first PMOS transistor is connected to a drain electrode of the second PMOS transistor and is connected to the first ground electrode.

Preferably, the first switch and the second switch are connected in parallel, and then are connected to a ground output pin of the MCU and then are grounded.

Preferably, the MCU, the first drive circuit and the second drive circuit are integrated on a PCB board, and the PCB board is located inside the press portion.

Preferably, the contact protrusion and the press wheel are symmetrically arranged with respect to a rotating shaft of the drive wheel.

Preferably, the contact protrusion has an arc shape which is consistent with a motion locus of the fixed point located at the contact protrusion when the drive wheel rotates.

BRIEF DESCRIPTION OF THE DRAWINGS

For more clearly illustrating embodiments of the present application or technical solutions in the conventional technology, drawings referred to describe the embodiments or the conventional technology will be briefly described hereinafter. Apparently, the drawings in the following description are only some examples of the present application, and for the person skilled in the art, other drawings may be obtained based on the provided drawings without any creative efforts.

DETAILED DESCRIPTION

The technical solutions of the embodiments of the present application will be clearly and completely described hereinafter in conjunction with the drawings of the embodiments of the present application. Apparently, the embodiments described are only some examples of the present application, rather than all implementations. Other embodiments obtained by the person skilled in the art based on the embodiments of the present application without any creative efforts all fall into the scope of the present application.

To make the person skilled in the art to better understand the technical solution of the present application, the present application is illustrated in further detail hereinafter in conjunction with the drawings and the specific embodiments.

Figure 1:
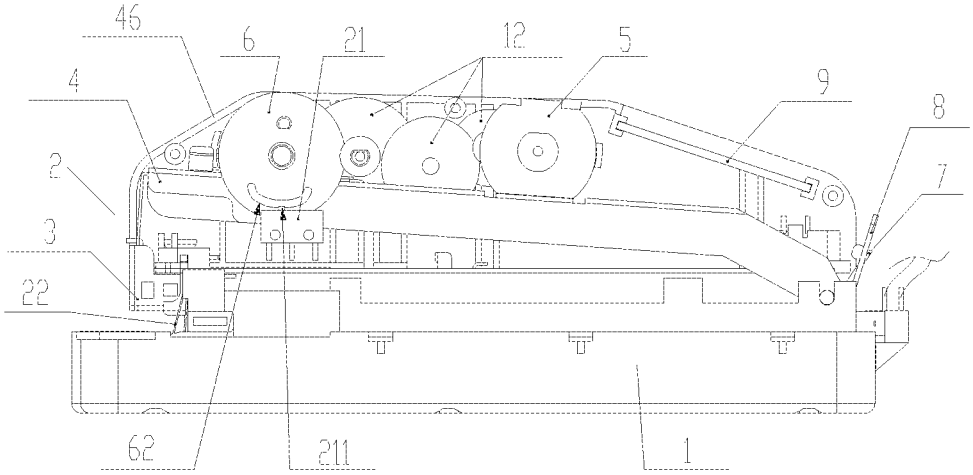
FIG. 1 is a schematic view of an electric stapler according to an embodiment of the present application in a non-operational state.
Figure 2:
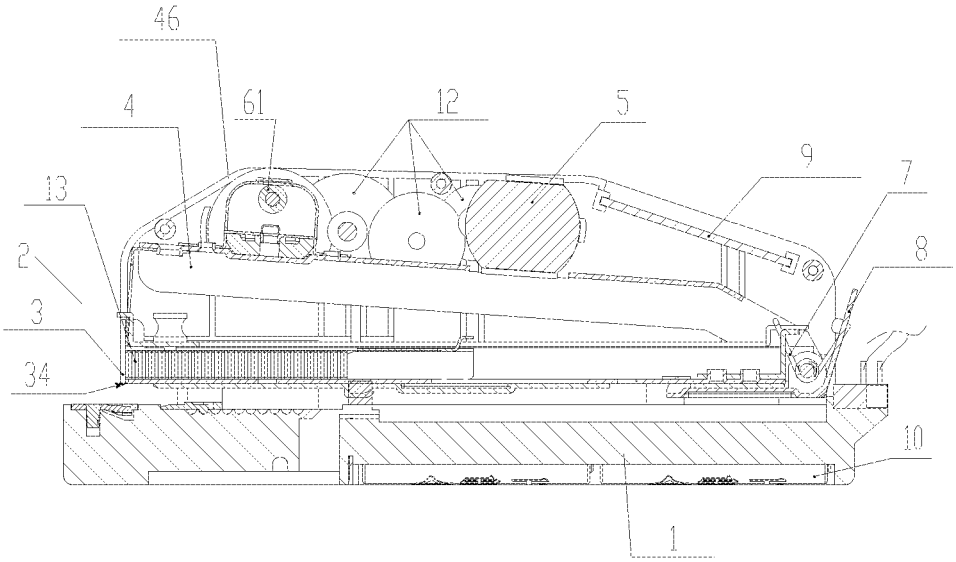
FIG. 2 is a sectional view of FIG. 1.
Figure 3:
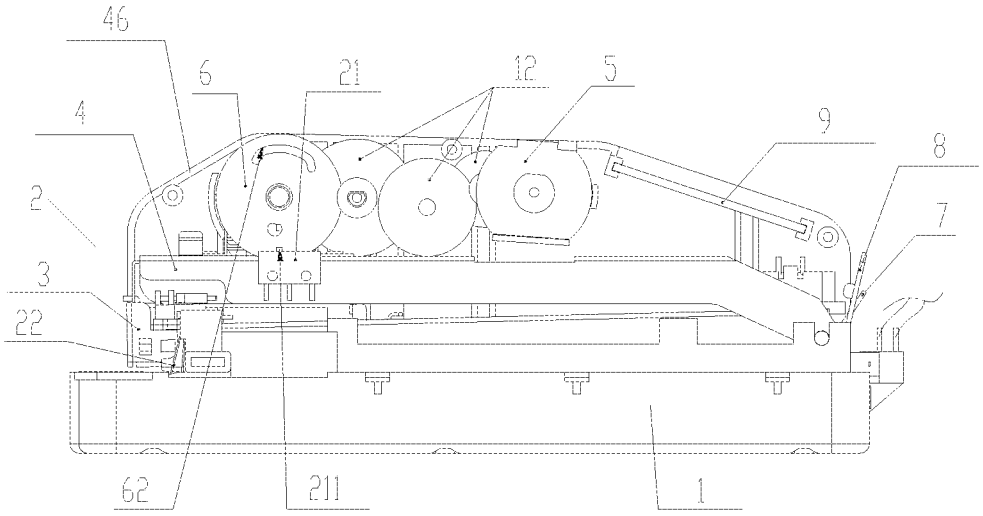
FIG. 3 is a schematic view of the electric stapler according to an embodiment of the present application in a staple pressing state.
Figure 4:
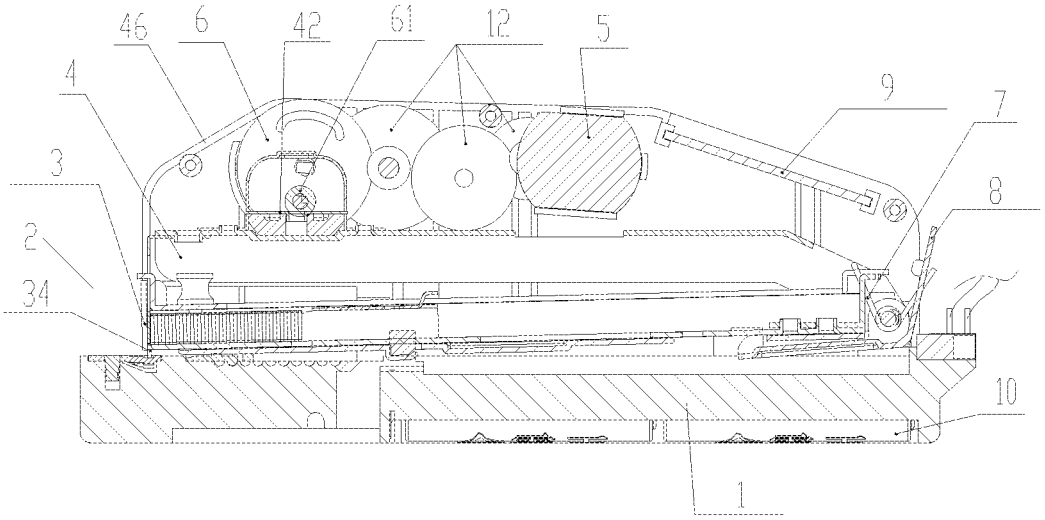
FIG. 4 is a sectional view of FIG. 3.
Figure 5:
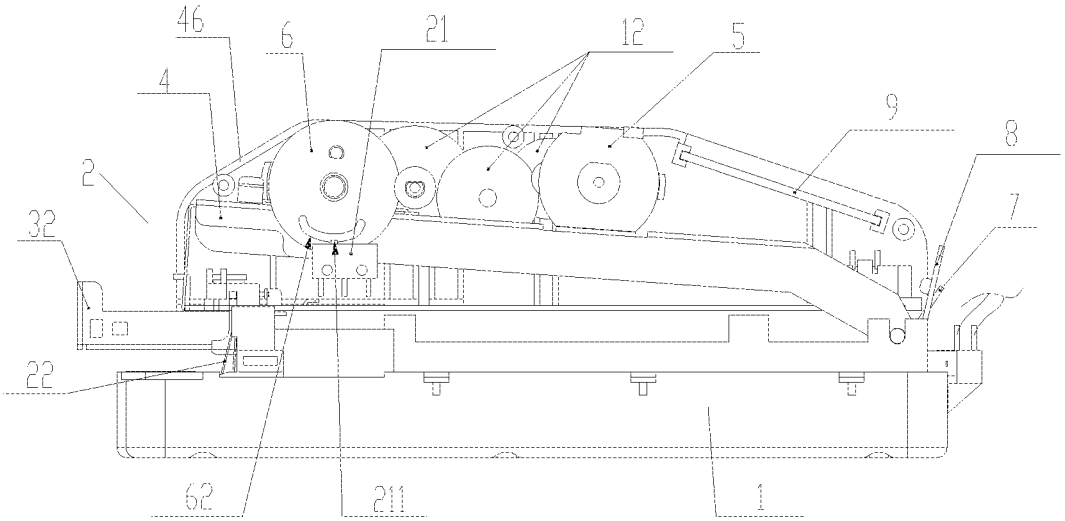
FIG. 5 is a schematic view of the electric stapler according to an embodiment of the present application in a staple stuck state.
Figure 6:
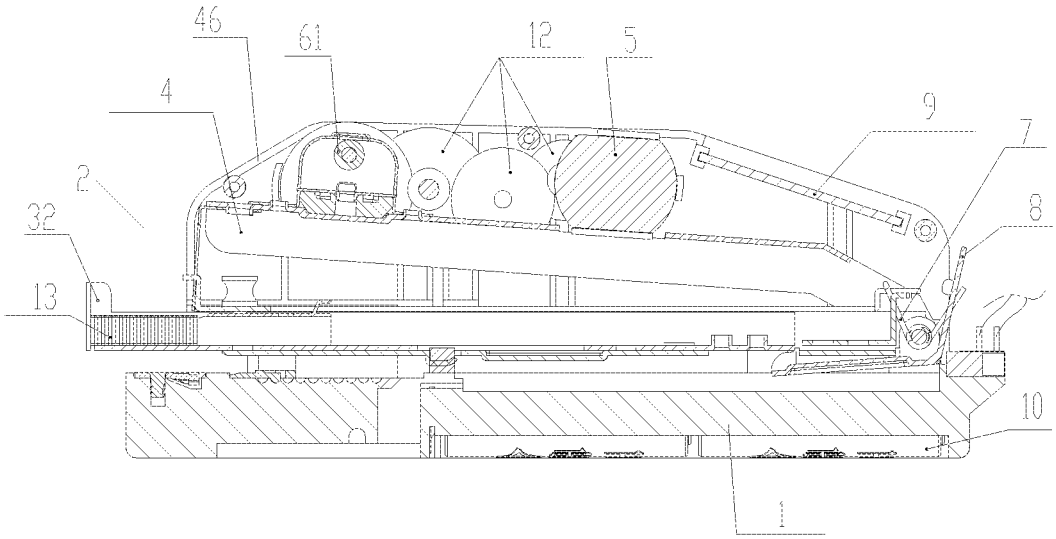
FIG. 6 is a sectional view of FIG. 5.
Figure 7:
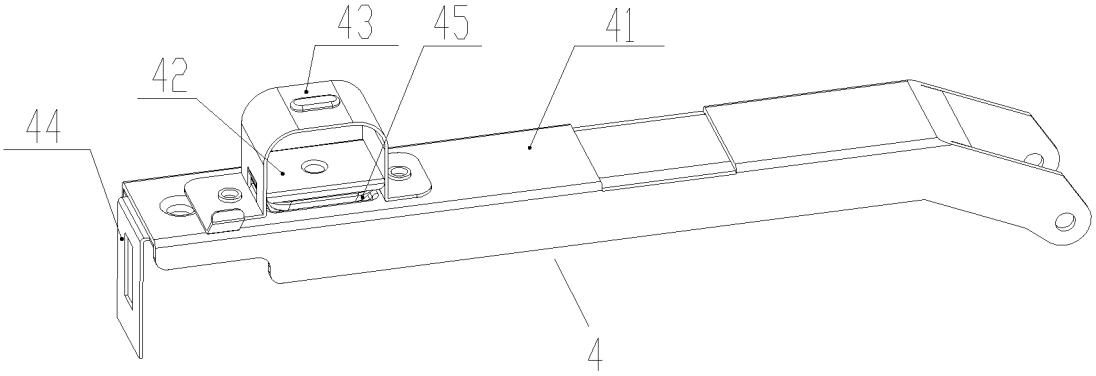
FIG. 7 is a schematic view showing the structure of a staple pressing plate assembly in FIG. 1.
Figure 8:
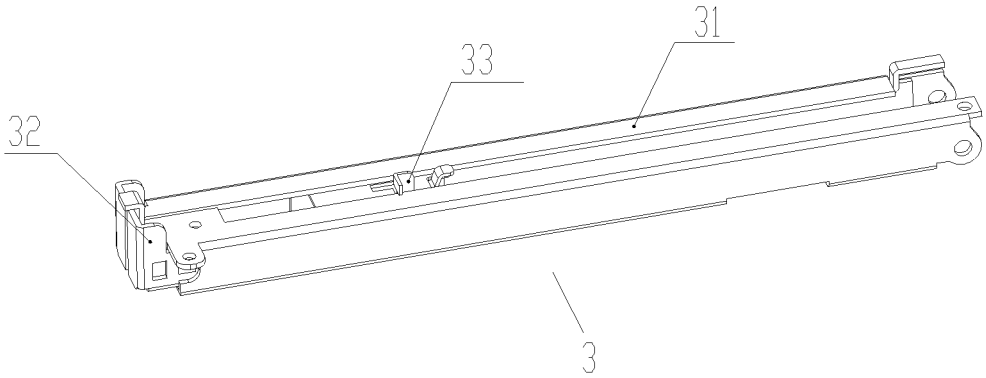
FIG. 8 is a schematic view showing the structure of a staple channel assembly in FIG. 1.
Figure 9:
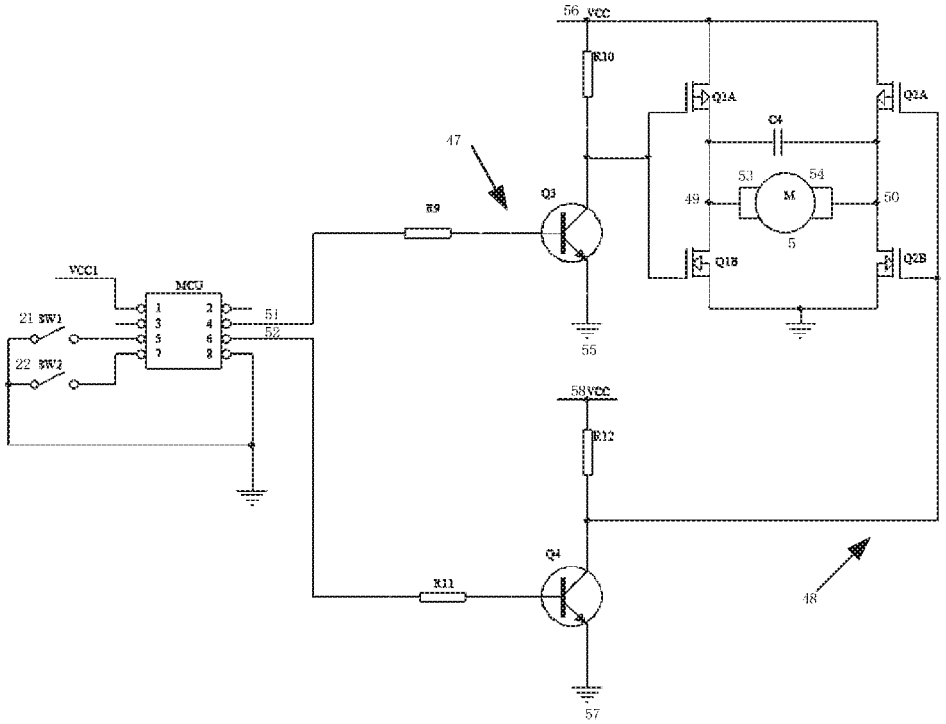
FIG. 9 is a schematic circuit diagram of the electric stapler according to an embodiment of the present application.

Reference is made to FIGS. 1 to 9. FIG. 1 is a schematic view of an electric stapler according to an embodiment of the present application in a non-operational state; FIG. 2 is a sectional view of FIG. 1; FIG. 3 is a schematic view of the electric stapler according to the embodiment of the present application in a staple pressing state; FIG. 4 is a sectional view of FIG. 3; FIG. 5 is a schematic view of the electric stapler according to the embodiment of the present application in a staple stuck state; FIG. 6 is a sectional view of FIG. 5; FIG. 7 is a schematic view showing the structure of a staple pressing plate assembly in FIG. 1; FIG. 8 is a schematic view showing the structure of a staple channel assembly in FIG. 1; and FIG. 9 is a schematic circuit diagram of the electric stapler according to the embodiment of the present application.

The electric stapler according to the present application includes a base 1 and a press portion 2. A tail end of the press portion 2 is articulated to a tail end of the base 1. The press portion 2 is rotatable relative to the base 1.

The press portion 2 is provided with, from down to up, a staple channel assembly 3, a staple pressing plate assembly 4 and a drive assembly. The press portion 2 includes a casing 46. The staple channel assembly 3, the staple pressing plate assembly 4 and the drive assembly are located inside the casing 46. A position of the drive assembly is fixed to relative to the press portion 2. The staple channel assembly 3 and the staple pressing plate assembly 4 are movable relative to the casing 46.

In use, the paper to be bound is placed between the base I and the press portion 2. In other words, the paper is located on the base 1 and located below the staple channel assembly 3, the staple pressing plate assembly 4 and the drive assembly. The staple Channel assembly 3 and the staple pressing plate assembly 4 are rotatable downwards relative to the casing 46 to get close to the paper. At this time, the position of the casing 46 remains unchanged. Then the press portion 2 is pressed under the action of the drive assembly to allow the staple channel assembly 3, the staple pressing plate assembly 4 and the drive assembly to move downwards together and to rotate further towards the direction close to the paper, thus realizing the binding.

In the present application, the drive assembly includes a power unit 5 and an execution component. The power unit 5 may be a power component such as a motor. The execution component is driven to perform a corresponding action under the action of the power unit 5 to realize the pressing or raising of the staple pressing plate assembly 4 and thus ensuring that the staple pressing plate assembly 4 can get close or be away relative to the staple channel assembly 3.

When a failure such as staple stuck occurs, the failed staple is generally stuck between the staple pressing plate assembly 4 and the staple channel assembly 3 to disallow the staple pressing plate assembly 4 and the staple channel assembly 3 to move relative to each other. In the present application, the execution component is utilized to increase, under the action of the power unit 5 such as the motor, the space between the staple pressing plate assembly 4 and the staple channel assembly 3, and thus the failed staple can be removed, which avoids the inconvenience of human operation and improves maintenance efficiency.

Regarding the specific arrangement of the power unit 5 and the execution component, the device in the conventional technology which allows two components to be separated and engaged, for example, some link mechanisms or drive mechanisms, may be referred. In the present application, only one embodiment is provided hereinafter.

As shown in FIG. 7, the staple pressing plate assembly 4 includes a fixed plate 41, a staple pressing plate 44, a return stroke ring 43 and a press plate 42. The fixed plate 41 extends along an axial direction of the base 1. Both the fixed plate 41 and the base 1 have a substantially long strip shape. The staple pressing plate 44 is located at a front end of the fixed plate 41 and extends vertically downwards to press a staple 13 in the staple channel assembly 3 out to realize the binding.

The return stroke ring 43 has an arched shape and is located on an upper surface of the fixed plate 41. The return stroke ring 43 and the staple pressing plate 44 are spaced apart axially by a certain distance. The press plate 42 is located on the upper surface of the fixed plate 41 and located within an area of the return stroke ring 43. A soft rubber 45 is further provided between the press plate 42 and the upper surface of the fixed plate 41 to address the issue of different vertical strokes of the staple pressing plate assembly caused by binding paper of different thicknesses and provide buffer effects.

Regarding the execution component, as shown in FIGS. 1 to 6, a drive wheel 6 is included. The drive wheel 6 is provided with a press wheel 61. The press wheel 61 is arranged on the surface of the drive wheel 6 and extends axially by a certain distance.

The press wheel 61 is always located within a space area defined by the return stroke ring 43 and can abut against the press plate 42 and the return stroke ring 43. In the case that the drive wheel 6 is rotated in a first direction, the press wheel 61 stops rotating after pressing the press plate 42 downwards, to drive the staple pressing plate assembly 4 to press the staple channel assembly 3 downwards. In the case that the drive wheel 6 is rotated in a second direction, the press wheel 61 abuts against an inner wall of a top of the return stroke ring 43 and drives the staple pressing plate assembly 4 to rotate in a direction away from the staple channel assembly 3.

It should be noted that the drive wheel 6 may also always rotate in the first direction, and the press wheel 61 may continue to rotate after pressing the press plate 42 downwards, to allow the press wheel 61 to be separated from the press plate 42, and move to an inner side of the top of the return stroke ring 43, to achieve the separation of the staple pressing plate assembly 4 from the staple channel assembly 3. The above process runs in cycle. Thus, the process in which the staple pressing plate assembly 4 is fitted with the staple channel assembly 3, disengaged from the staple channel assembly 3, and fitted with the staple channel assembly 3 again may just be achieved simply by rotating the drive wheel 6 always in the first direction.

As described, in the case that the drive wheel 6 is rotated in the second direction, the press wheel 61 abuts against the inner wall of the top of the return stroke ring 43. This process may also be realized by rotating the drive wheel 6 always in the first direction. In the present application, for distinguishing different movement processes of the electric stapler in a normal movement state and in a staple stuck state, the drive wheel 6 is set to rotate in two different ways, i.e., rotating in the first direction and in the second direction.

In the case that the electric stapler is in a non-operational state, the press wheel 61 is close to the top and fits the inner wall of the top of the return stroke ring 43. In this case, the staple pressing plate assembly 4 keeps a certain distance from the staple channel assembly 3.

When the electric stapler starts to operate, the press wheel 61 rotates in the first direction under the action of the drive wheel 6. When the press wheel 61 rotates to a lower side to fit the press plate 42 and press the press plate 42 downwards, the drive wheel 6 stops rotating. At this time, the press plate 42 pressed downwards by the press wheel 61 drives the staple pressing plate assembly 4 to rotate in a direction close to the staple channel assembly 3, to allow the staple pressing plate assembly 4 to fit the staple channel assembly 3. Then the press portion 2 is pressed downwards under the action of the drive assembly to allow the whole press portion 2 to rotate downwards, thus completing the binding.

In the case that the staple stuck phenomenon occurs, the drive wheel 6 rotates in the second direction to allow the press wheel 61 to rotate in a direction away from the staple channel assembly 3, to allow the press wheel 61 to abut against the inner wall of the top of the return stroke ring 43, thereby enlarging a distance of the staple pressing plate assembly 4 from the staple channel assembly 3, and thus, removing of the failed staple 13 is realized.

Regarding the arrangement of the staple channel assembly 3, as shown in FIG. 8 of the specification, the staple channel assembly 3 includes a staple channel sliding groove 31 articulated to the base 1. The staple channel sliding groove 31 is provided with a slidable staple channel 32. A torsion spring 7 and a staple channel draw hook 8 are provided at a tail end of the staple channel assembly 3 and abut against the staple channel 32. A staple pusher 33 is slidable along the staple channel 32 to push the staple 13 to move forwards. The conventional technology may also be referred for the arrangement of the above components and thus it is not described herein.

The power unit 5 is powered by a battery 10. The battery 10 is arranged inside the base 1. In the present application, to realize the automatic rotation of the drive wheel 6, an MCU, a first switch 21, a second switch 22, a first drive circuit 47 and a second drive circuit are further provided, as shown in FIG. 9.

The first switch 21 is arranged on the press portion 2. The drive wheel 6 is provided with a contact protrusion 62. The contact protrusion 62 extends in an axial direction of the drive wheel 6. The first switch 21 provided with a press-button 211 is arranged below the drive wheel 6. With the drive wheel 6 being rotated, the contact protrusion 62 can abut against the press-button 211.

When the drive wheel 6 rotates to a position at which the contact protrusion 62 of the drive wheel 6 abuts against the press-button 211 of the first switch 21, the first switch 21 is turned on. When the contact protrusion 62 is separated from the press-button 211, the first switch 21 is turned off.

The second switch 22 is arranged below a staple outlet 34 of the staple channel assembly 3. In the case that the paper touches the second switch 22, the second switch 22 is turned on. In the case that paper does not touch the second switch 22, the second switch 22 is turned off The first switch 21 and the second switch 22 are connected to two input pins of the MCU respectively. As shown in FIG. 9, a first pin, a third pin, a fifth pin and a seventh pin of the MCU are all input pins, while a second pin, a fourth pin, a sixth pin and an eighth pin of the MCU are all output pins.

The first switch 21 is connected to the fifth pin of the MCU. The second switch 22 is connected to the seventh pin of the MCU. A first end 51 of the first drive circuit 47 is connected to the fourth pin of the MCU. A first end 52 of the second drive circuit 48 is connected to the sixth pin of the MCU.

A second end 49 of the first drive circuit 47 is connected to a first end 53 of the power unit 5, namely, a left end of a motor M in FIG. 9. A second end 50 of the second drive circuit 48 is connected to a second end 54 of the power unit 5, namely, a right end of the motor M in FIG. 9. The second end 49 of the first drive circuit 47 is in communication with the second end 50 of the second drive circuit 48.

A first ground electrode 55 and a first voltage electrode are connected between the first end 51 of the first drive circuit 47 and the second end 49 of the first drive circuit 47. A second ground electrode 57 and a second voltage electrode are connected between the first end 52 of the second drive circuit 48 and the second end 50 of the second drive circuit 48.

In the case that the first switch 21 is turned on and the second switch 22 is turned off, the power unit 5 keeps still. In the case that the first switch 21 is turned on and the second switch 22 is turned on, the power unit 5 is rotated in the first direction. In the case that the first switch 21 is turned off and the second switch 22 is turned on, the power unit 5 is rotated in the second direction.

In the present application, more specifically, the first drive circuit 47 includes a first NPN-type triode Q3, a first PMOS transistor QIA and a first NMOS transistor Q1B. The serial numbers of electronic elements are consistent with those shown in FIG. 9 and thus they are not described hereinafter.

A base of the first NPN-type triode Q3 is connected to the MCU, and a resistance R9 may he connected in series therebetween. An emitter of the first NPN-type triode Q3 is connected to the first ground electrode 55. A collector of the first NPN-type triode Q3 is connected to a first voltage electrode VCC 56. The first voltage electrode VCC 56 is located at an upper right position in FIG. 9, and a resistance R10 may be connected in series between the collector of the first NPN-type triode Q3 and the first voltage electrode VCC 56.

A grid electrode of the first PMOS transistor QIA and a grid electrode of the first NMOS transistor Q1B are both connected between the collector of the first NPN-type triode Q3 and the first voltage electrode VCC 56.

A source electrode of the first PMOS transistor Q1A and a drain electrode of the first NMOS transistor Q1B are both connected to the first end of the motor M.

The second drive circuit 48 includes a second NPN-type triode Q4, a second PMOS transistor Q2A and a second NMOS transistor Q2B.

A base of the second NPN-type triode Q4 is connected to the MCU, and resistance R11 may be connected in series between the base of the second NPN-type triode Q4 and the MCU. An emitter of the second NPN-type triode Q4 is connected to a second ground electrode 57. A collector of the second NPN-type triode Q4 is connected to a second voltage electrode VCC 58, and a resistance R12 may be connected in series between the collector of the second NPN-type triode Q4 and the second voltage electrode VCC 58.

A grid electrode of the second PMOS transistor Q2A and a grid electrode of the second NMOS transistor Q2B are both connected between the collector of the second NPN-type triode Q4 and the second voltage electrode VCC 58.

A source electrode of the second PMOS transistor Q2A and a drain electrode of the second NMOS transistor Q2B are both connected to the second end of the motor M.

A source electrode of the first NMOS transistor Q1B is connected to a source electrode of the second NMOS transistor and grounded. The source electrode of the first PMOS transistor Q1A and the source electrode of the second PMOS transistor are connected. A drain electrode of the first PMOS transistor Q1A is connected a drain electrode of the second PMOS transistor and connected to the first ground electrode 55.

The first switch 21 (i.e., SW1 in FIG. 9 of the specification) and the second switch 22 (i.e., SW2 in FIG. 9 of the specification) are connected in parallel, and then are connected to a ground output pin (i.e., the eighth pin) of the MCU and then are grounded. The specific connection way is as shown in FIG. 9 of the specification.

The electric stapler according to the present application functions based on the following principle. In a non-operational state, as shown in FIGS. 1 and 2 of the specification, the second switch 22 is in a turned-off state, and the contact protrusion 62 of the drive wheel 6 presses the press-button 211 of the first switch 21 to allow the first switch 21 to be in a turned-on state. At this time, the fourth pin and the sixth pin of the MCU each output a high level, and the two ends of the motor M (i.e., the power unit 5) are each at a high level and the motor M does not rotate, as shown in schematic circuit diagram of FIG. 6.

When paper is put into the stapler, and actuates the second switch 22, the second switch 22 is turned-on, the fourth pin of the MCU outputs a low level, and the sixth pin outputs a high level. At this time, the voltage at the right end of the motor M is high, and the voltage at the left end is low, and the motor M starts to rotate.

When the motor M rotates, the drive wheel 6 is driven by a transmission gear 12 to rotate. During the rotation of the drive wheel 6, the press wheel 61 mounted on the drive wheel 6 presses the press plate 42 of the staple pressing plate assembly 4. The staple pressing plate assembly 4 is driven by the press plate 42 to press the staple 13. The staple 13 in turn drives the staple channel assembly 3 to press paper after the staple 13 is pressed by the staple pressing plate 44. After paper is pressed by the staple channel assembly 3, the staple channel assembly 3 stops rotating. The staple 13, continuously pressed by the staple pressing plate 44, is driven into paper through the staple outlet 34 of the staple channel. When the paper is taken away, the second switch 22 is switched from a turned-on state into a turned-off state, and the first switch 21 is in a turned-on state, and a new operation may be performed again.

In the case that abnormity occurs during the binding, generally it is that the staple 13 is stuck at the staple outlet 34 of the staple channel, the drive wheel 6 cannot rotate anymore in this case, and the press wheel 61 fixed to the drive wheel 6 may always press on the press plate 42 of the staple pressing plate assembly 4. In this case, the contact protrusion 62 of the drive wheel 6 is always in a state of being disengaged from the press-button 211 of the first switch 21, and the first switch 21 is always in a turned-off state.

As mentioned above, in the normal operational state of the electric stapler, the motor M always rotates in the first direction, and the first switch 21 is in the process of being sequentially turned-on, turned-off and turned-on again. The time starting from the paper touching the second switch 22 to turn-on the second switch 22 to the first switch 21 being turned-on for the second time generally ranges from 300 ms to 500 ms. If the time exceeds the range from 500 ms to 2s, a controller may output a corresponding signal, the fourth pin of the MCU outputs a high level, and the sixth pin of the MCU outputs a low level. At this time, the voltage at the left end of the motor M becomes high and the voltage at the right end becomes low, and the motor M starts to rotate reversely (the controller determines abnormity by the detection of the time). Then the drive wheel 6 is driven by the transmission gear 12 to rotate reversely. The drive wheel 6 presses the return stroke ring 43 of the staple pressing plate assembly 4 by the press wheel 61 fixed to the drive wheel 6. Then the staple pressing plate assembly 4 is driven by the return stroke ring 43 to move in a direction away from the staple 13. At this time, the staple pressing plate 44 may drive the staple channel sliding groove 31 to move together, and the staple channel sliding groove 31 in turn drives the staple channel assembly 3 to move together in the direction away from the paper to allow the staple outlet 34 of the staple channel to separate from the paper. At this time, the staple channel draw hook 8 is then strongly pressed, and the staple channel 32 may be sprung out of the staple channel sliding groove 31 under the action of the torsion spring 7. At this time, the failed staple may be smoothly removed, as shown in FIGS. 5 and 6 of the specification. When the failed staple is removed, the staple channel 32 is pushed back till the staple channel draw hook 8 hooks the staple channel 32, and thus the entire removing process is completed, and the stapler returns to a normal binding state again, and thus the next binding may be performed. During the reverse rotation of the drive wheel 6, the first switch 21 is always in a turned-off state. When a switch pressing contact portion of the drive wheel 6 presses a contact of the first switch 21 again, the first switch 21 is turned-on again. After this signal is detected by the controller, the controller outputs a corresponding control signal. The voltages at the two ends of the motor M become high levels simultaneously in turn. Thus, the rotation would be stopped and the entire process would return to an initial state.

The MCU, the first drive circuit and the second drive circuit described above are integrated to a PCB board 9. As shown in FIGS. 1 and 6, the PCB board 9 is located inside the press portion 2. With such an arrangement, an interior space of the casing can be utilized efficiently. Furthermore, the PCB board 9 is located on a rear end of the power unit 5. Also, the rear end of the casing may be provided with an opening for facilitating the maintenance and mounting of the PCB board 9.

The contact protrusion 62 and the press wheel 61 are symmetrically arranged with respect to a rotary shaft of the drive wheel 6. In other words, the contact protrusion 62 and the press wheel 61 are symmetrically arranged at the two sides of the rotating shaft of the drive wheel 6 to allow the contact protrusion 62 and the press wheel 61 to perform their respective functions when the drive wheel 6 is rotated by half turn. Also, the symmetric arrangement is advantageous for a simplified control and avoids a complicated logic design.

The contact protrusion 62 has an arc shape with an arc consistent with a motion locus of a fixed point located at the contact protrusion 62 when the drive wheel 6 rotates. In other words, when the contact protrusion 62 contacts the press-button 211, the drive wheel 6, during the rotation, can constantly keep an pressing action of the contact protrusion 62 on the press-button 211, and thus ensuring that the first switch 21 is always in a turned-off state. Moreover, as long as the contact protrusion 62 is in contact with the press-button 211, the force applied by the contact protrusion 62 on the press-button 211 is consistent, thus preventing the press-button 211 from being damaged due to being pressed by the contact protrusion 62 during the rotation of the drive wheel 6, thereby improving a service life.

It is to be noted that, in this specification, the relationship terms such as "first", "second" and the like are only used to distinguish one entity from other entities and are not necessarily require or imply that any such actual relationship or sequence exists between these entities.

The electric stapler according to the present application is described in detail hereinbefore. The principle and the embodiments of the present application are illustrated herein by specific examples. The above description of the examples is only intended to help the understanding of the idea of the present application. It should be noted that, for the person skilled in the art, a few of modifications and improvements may be made to the present application without departing from the principle of the present application, and these modifications and improvements are also deemed to fall into the scope of the present application defined by the claims.

The invention claimed is:

1. An electric stapler, comprising: a base and a press portion articulated to the base, wherein the press portion is provided with, in sequence from down to up, a staple channel assembly configured to receive a staple, a staple pressing plate assembly configured to press downwards the staple, and a drive assembly;

a position of the drive assembly keeps fixed relative to a casing of the press portion, the staple channel assembly and the staple pressing plate assembly are rotatable relative to the casing of the press portion; and the drive assembly comprises a power unit and an execution component connected to the power unit to press downwards or raise the staple pressing plate assembly; and wherein the staple pressing plate assembly comprises:

a fixed plate extending axially along the base;

a staple pressing plate arranged at a front end of the fixed plate and extending vertically downwards;

a return stroke ring having an arched shape and arranged on an upper surface of the fixed plate; and a press plate arranged at the upper surface of the fixed plate and located within an area of the return stroke ring; and wherein the execution component comprises:

a drive wheel; and a press wheel arranged at the drive wheel and capable of abutting against the press plate and the return stroke ring;

when the drive wheel rotates in a first direction press wheel presses downwards the press plate, to drive the staple pressing plate assembly to press downwards the staple channel assembly; and when the press wheel is separated from the press plate and the drive wheel continues to rotate in the first direction, the press wheel abuts against an inner wall of the top of the return stroke ring and drives the staple pressing plate assembly to move in a direction away from the staple channel assembly; and the electric stapler further comprises a MCU (Microcontroller Unit), a first switch, a second switch, a first drive circuit and a second drive circuit, wherein the first switch is arranged at the press portion, the drive wheel is provided with a contact protrusion, when the drive wheel rotates to abut the contact protrusion against a press-button of the first switch, the first switch is turned-on, and when the contact protrusion is separated from the press-button, the first switch is turned-off;

the second switch is arranged below a staple outlet of the staple channel assembly, and when papers touch the second switch, the second switch is turned-on, and when the papers do not touch the second switch the second switch is turned-off;

the first switch and the second switch are connected to two input pins of the MCU respectively;

a first end of the first drive circuit and a first end of the second drive circuit are connected to two output pins of the MCU respectively, a second end of the first drive circuit is connected to a first end of the power unit, a second end of the second drive circuit is connected to a second end of the power unit, and the second end of the first drive circuit is in communication with the second end of the second drive circuit;

a first ground electrode and a first voltage electrode are connected between the first end of the first drive circuit and the second end of the first drive circuit, a second ground electrode and a second voltage electrode are connected between the first end of the second drive circuit and the second end of the second drive circuit; and when the first switch is turned-on and the second switch is turned-off, the power unit keeps still, when the first switch is turned-on and the second switch is turned-on, the power unit is rotated in a first direction, and when the first switch is turned-off and the second switch is turned-on, the power unit is rotated in a second direction.

2. The electric stapler according to claim 1, wherein the staple channel assembly comprises a staple channel sliding groove articulated to the base, the staple channel sliding groove is provided with a slidable staple channel; a torsion spring and a staple channel draw hook are provided at a tail end of the staple channel assembly and abut against the slidable staple channel.

3. The electric stapler according to claim 1, wherein a battery configured for the power unit to rotate is arranged inside the base.

4. The electric stapler according to claim 1, wherein the first drive circuit comprises a first NPN triode, a first PMOS transistor and a first NMOS transistor, wherein:

a base of the first NPN triode is connected to the MCU, an emitter of the first NPN triode is connected to the first ground electrode, and a collector of the first NPN triode is connected to the first voltage electrode;

a grid electrode of the first PMOS transistor and a grid electrode of the first NMOS transistor are both connected between the collector of the first NPN triode and the first voltage electrode;

a source electrode of the first PMOS transistor and a drain electrode of the first NMOS transistor are both connected to the first end of the power unit; and the second drive circuit comprises a second NPN triode, a second PMOS transistor and a second NMOS transistor, wherein:

a base of the second NPN triode is connected to the MCU, an emitter of the second NPN triode is connected to the second ground electrode, a collector of the second NPN triode is connected to the second voltage electrode;

a grid electrode of the second PMOS transistor and a grid electrode of the second NMOS transistor are both connected between the collector of the second NPN triode and the second voltage electrode;

a source electrode of the second PMOS transistor and a drain electrode of the second NMOS transistor are both connected to the second end of the power unit; and a source electrode of the first NMOS transistor is connected to a source electrode of the second NMOS transistor and is grounded, the source electrode of the first PMOS transistor and the source electrode of the second PMOS transistor are connected, a drain electrode of the first PMOS transistor is connected to a drain electrode of the second PMOS transistor and is connected to the first ground electrode.

5. The electric stapler according to claim 4, wherein the first switch and the second switch are connected in parallel, and then are connected to a ground output pin of the MCU and then are grounded.

6. The electric stapler according to claim 4, wherein the MCU, the first drive circuit and the second drive circuit are integrated to a PCB board, and the PCB board is located inside the press portion.

7. The electric stapler according to claim 4, wherein the contact protrusion and the press wheel are symmetrically arranged with respect to a rotating shaft of the drive wheel.

8. The electric stapler according to claim 7, wherein the contact protrusion has an arc shape which is consistent with a motion locus of a fixed point located at the contact protrusion when the drive wheel rotates.

* * * * *